US010053200B1

(12) United States Patent
Koetsier et al.

(10) Patent No.: US 10,053,200 B1
(45) Date of Patent: Aug. 21, 2018

(54) UNIVERSAL PROPULSION SYSTEMS FOR SMALL BOATS

(71) Applicant: Brunswick Corporation, Lake Forest, IL (US)

(72) Inventors: Nathan D. Koetsier, Marne, MI (US); Eric S. Deuel, Allendale, MI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/635,967

(22) Filed: Jun. 28, 2017

(51) Int. Cl.

| | |
|---|---|
| ***B63H 20/14*** | (2006.01) |
| ***B63H 20/06*** | (2006.01) |
| ***B63B 35/71*** | (2006.01) |
| ***B63H 20/20*** | (2006.01) |

(52) U.S. Cl.
CPC ..... *B63H 20/14* (2013.01); *B63B 35/71* (2013.01); *B63H 20/06* (2013.01); *B63H 20/20* (2013.01); *B63B 2749/00* (2013.01); *B63B 2755/00* (2013.01)

(58) Field of Classification Search
CPC ..... B63H 20/00; B63H 20/02; B63H 20/06; B63H 21/00; B63H 21/17; B63H 21/22; B63H 25/02; B63H 20/14; B63H 20/007; B60L 11/02; B60L 11/18
USPC ..... 114/347, 364; 440/6, 53; 248/640, 643
See application file for complete search history.

(56) References Cited

U.S. PATENT DOCUMENTS

| | | | |
|---|---|---|---|
| 4,229,850 | A | 10/1980 | Arcouette |
| 5,481,997 | A | 1/1996 | Arndt |
| 5,499,792 | A | 3/1996 | Tamiso |
| 5,941,742 | A | 8/1999 | Whitaker |
| 5,964,177 | A | 10/1999 | Niemier |
| 6,132,267 | A | 10/2000 | Campbell |
| 7,887,381 | B2 | 2/2011 | Brass et al. |
| 8,091,501 | B2 | 1/2012 | Lazarevic |
| 8,336,475 | B2 | 12/2012 | Morin |
| 8,516,973 | B1 | 8/2013 | Hamilton |
| 9,290,251 | B1 | 3/2016 | Schmidtke |
| 2002/0195039 | A1 | 12/2002 | Anderson |
| 2004/0255836 | A1 | 12/2004 | Hopkins |
| 2006/0102063 | A1 | 5/2006 | Boelryk |
| 2006/0254495 | A1 | 11/2006 | Eckert |
| 2007/0012236 | A1 | 1/2007 | Caples |
| 2009/0042461 | A1 | 2/2009 | Walton |
| 2010/0012814 | A1 | 1/2010 | Boebel |

(Continued)

OTHER PUBLICATIONS

Hobie, "Noble Evolve", web article, last accessed May 11, 2017, available at https://www.hobie.com/accessories/evolve.

(Continued)

*Primary Examiner* — Lars A Olson
(74) *Attorney, Agent, or Firm* — Andrus Intellectual Property Law, LLP

(57) ABSTRACT

A universal boat propulsion system is provided for a boat that is defined in a length direction, a width direction, and a depth direction. The universal boat propulsion system includes a support assembly that spans the boat in the width direction, a clamping assembly that secures the support assembly on the boat, and a pair of shafts coupled to respective opposite ends of the support assembly. Each shaft in the pair of shafts extends in a depth direction. A pair of propulsion devices produce thrust to propel the boat. Each propulsion device in the pair of propulsion devices is supported by a respective one of the shafts. A user input device controls operation of the pair of propulsion devices.

18 Claims, 8 Drawing Sheets

(56) References Cited

U.S. PATENT DOCUMENTS

| | | | |
|---|---|---|---|
| 2014/0242857 | A1 | 8/2014 | Moffat, III et al. |
| 2014/0364020 | A1 | 12/2014 | Stone et al. |
| 2015/0367914 | A1 | 12/2015 | McDonough et al. |
| 2016/0229510 | A1 | 8/2016 | Aguirre |

OTHER PUBLICATIONS

Hobie, "Kayaking Parts & Accessories", brochure, dated 2017, pp. 24-25.

Old Town Canoe, "The Pedator MK", website, dated 2017, available at http://www.predatorkayak.com/mk/.

Torqeedo, "Ultralight 403", website, dated 2017, PDF download accessible at http://www.torqeedo.com/us/en-us/news-and-press/downloads/presentations/presentations.html.

UNIVERSAL PROPULSION SYSTEMS FOR SMALL BOATS

FIELD

The present disclosure relates to propulsion systems for use with small boats, such as, but not limited to, kayaks, canoes, or rowboats.

BACKGROUND

Many types of typically non-motorized small boats are available. Among these are kayaks, canoes, rowboats, and the like. Boaters may choose such non-motorized small boats in part due to the health benefits to the boater, who must propel the boat by using an oar or paddle. However, when engaging in certain activities on the water, a boater may wish to have the boat be motorized, at least temporarily. For example, this may allow the boater to fish while his or her kayak is propelled across a body of water, or may allow the boater to break from rowing or paddling for a while when in difficult upstream and/or wavy conditions, while still making progress on his or her journey.

Generally, small boats on the market can be motorized in one of a few ways. In one example, a motorized propeller is provided permanently on the boat. In another example, a designated hole in the bottom of the boat can be accessed by way of a hatch, and a motorized propeller inserted through the hole. These types of systems are not universal and can only be used with specially designed boats. In yet other examples, assemblies are provided that can be screwed or otherwise fastened into the side panels of the boat, which assemblies support a motorized propeller thereon. Installing these types of assemblies requires significant modification to the boat and/or irreversible damage thereto.

SUMMARY

This Summary is provided to introduce a selection of concepts that are further described below in the Detailed Description. This Summary is not intended to identify key or essential features of potentially claimed subject matter, nor is it intended to be used as an aid in limiting the scope of potentially claimed subject matter.

According to one example of the present disclosure, a universal boat propulsion system is provided for a boat that is defined in a length direction, a width direction, and a depth direction. The universal boat propulsion system includes a support assembly configured to span the boat in the width direction, a clamping assembly configured to secure the support assembly on the boat, and a pair of shafts coupled to respective opposite ends of the support assembly. Each shaft in the pair of shafts extends in a depth direction. A pair of propulsion devices configured to produce thrust to propel the boat is also provided. Each propulsion device in the pair of propulsion devices is supported by a respective one of the shafts. A user input device is configured to control operation of the pair of propulsion devices.

According to another example of the present disclosure, a universal boat propulsion system is provided for a boat that is defined in a length direction, a width direction, and a depth direction. The universal boat propulsion system includes a support assembly configured to span the boat in the width direction and clamping assembly configured to secure the support assembly on the boat. A pair of shafts is coupled to respective opposite ends of the support assembly, and each shaft in the pair of shafts extends in the depth direction. A pair of propulsion devices is powered by a pair of electric motors, respectively, and is configured to produce thrust to propel the boat. Each propulsion device in the pair of propulsion devices is supported by a respective one of the shafts. A user input device is provided for inputting speed and direction commands to control the thrust produced by the pair of propulsion devices. A control module interprets the speed and direction commands from the user input device and translates the speed and direction commands into control signals for controlling a speed and a rotational direction of each electric motor in the pair of electric motors.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
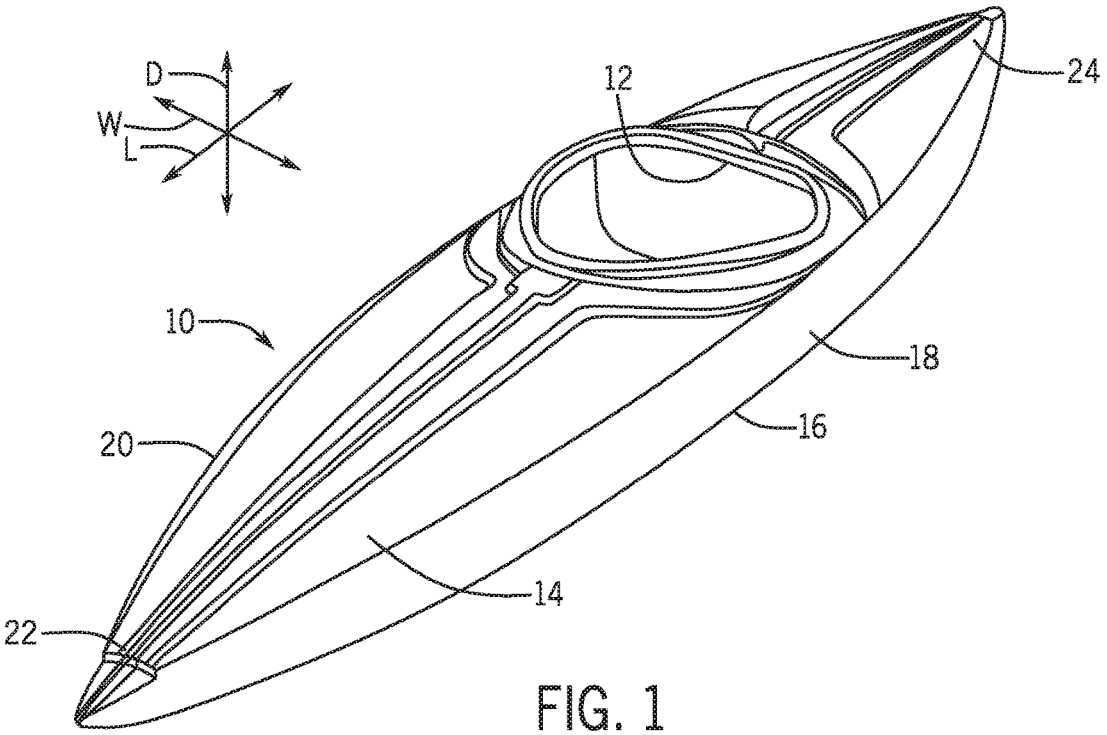
FIG. 1 shows an exemplary boat according to the present disclosure.

FIG. 1 illustrates on example of a boat 10 that is defined in a length direction L, a width direction W, and a depth direction D. The boat 10 show herein is a sit-in kayak, and thus includes an opening 12 in an otherwise enclosed hull where a boater would climb into the kayak and sit with his or her feet stretched out underneath the top surface 14 of the kayak. However, the type of kayak is not limiting on the scope of the present disclosure, and the kayak could instead be a sit-on-top kayak. Additionally, the kayak could be used for many different types of activities, and therefore could be an ocean kayak, a fishing kayak, or a general recreational kayak. Note too that although a kayak is show herein, the universal boat propulsion system to be described herein below could be used with any type of small boat on which the propulsion system is proportioned to fit, such as, but not limited to, a canoe or a rowboat. The boat 10 shown herein has the above-mentioned top surface 14, a bottom surface 16, and two lateral sides 18, 20 spaced apart in the width direction W. In the length direction L, the boat 10 has a front 22 and back 24. Note that if the boat 10 was a sit-on-top kayak, a canoe, or a rowboat, the lateral sides 18, 20 would be formed somewhat as lips, and the top surface 14 would be recessed from the lateral sides 18, 20 and generally immediately opposite the bottom surface 16.

Figure 2:
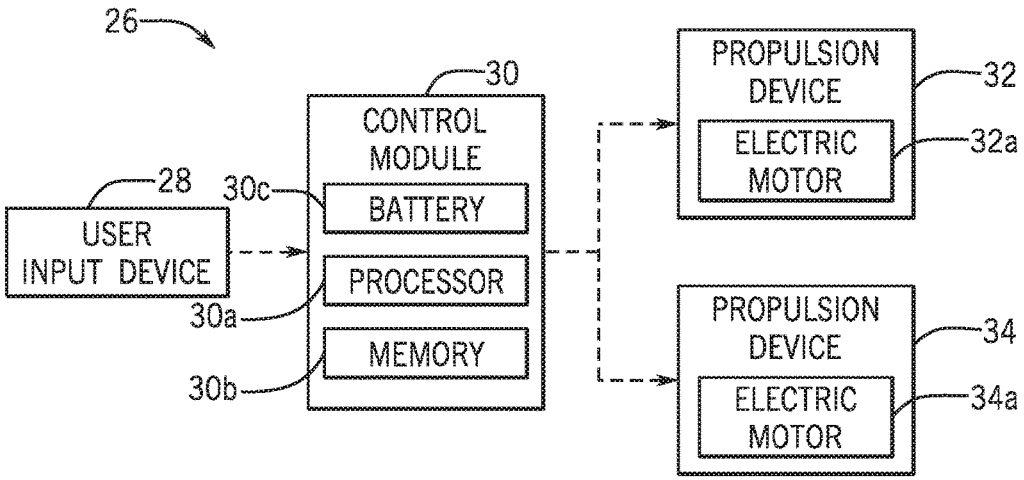
FIG. 2 illustrates a control system for a universal boat propulsion system according to the present disclosure.

Turning to FIG. 2, a control system 26 for the universal boat propulsion system disclosed herein will be described. The control system 26 includes a user input device 28, a control module 30, and two propulsion devices 32, 34. The user input device 28 is configured to control operation of the pair of propulsion devices 32, 34 by allowing the boater to input speed and direction commands to control the thrust produced by the pair of propulsion devices 32, 34. The control module 30 receives the speed and direction commands from the user input device 28 and interprets these speed and direction commands by way of a control algorithm. The control module 30 is programmable and may include a computing system that includes a processing system, storage system, software, and input/output (I/O) interfaces for communicating with peripheral devices. The systems may be implemented in hardware and/or software that carries out a programmed set of instructions. In the present example, the control module 30 includes a processor 30*a* and a memory 30*b*, and the processor 30*a* receives and interprets the commands from the user input device 28 by way of an algorithm saved in the memory 30*b*. The processor 30*a* can comprise a microprocessor, including a control unit and a processing unit, and other circuitry, such as semiconductor hardware logic, that retrieves and executes software from the memory 30*b*.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processor. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The memory 30*b* can comprise any storage media readable by the processor 30*a* and capable of storing software, and can include volatile and non-volatile, removable and non-removable media implemented in any method or technology for storage of information, such as computer-readable instructions, data structures, software program modules, or other data. The memory 30*b* can be implemented as a single storage device or across multiple storage devices. Non-limiting examples of storage media include random access memory, read-only memory, magnetic discs, optical discs, flash memory, virtual and non-virtual memory, and various types of magnetic storage devices. The storage media can be a transitory storage media or a non-transitory storage media such as a non-transitory tangible computer readable medium.

The control module 30 communicates with one or more components of the control system 26 via I/O interfaces and a communication link, which can be a wired or wireless link. The control module 30 is capable of monitoring and controlling one or more operational characteristics of the control system 26 by sending and receiving control signals via the communication link. The control module 30 functionally converts input signals, such as, but not limited to, speed and direction commands from the user input device 28, to output signals, such as, but not limited to, electric motor actuator control signals, according to the computer executable instructions.

Each propulsion device 32, 34 includes an electric motor 32*a*, 34*a*, respectively, which electric motors 32*a*, 34*a* are powered by a battery 30*c*. Although the battery 30*c* is shown as being in the control module 30, the battery 30*c* could be provided separately from the control module 30 and/or within one or both of the propulsion devices 32, 34. The electric motors 32*a*, 34*a* turn propellers 46, 48 (see FIGS. 3 and 4) to produce thrust to propel the boat 10. As described elsewhere herein, because the control module 30 provides signal communication between the user input device 28 and each electric motor 32*a*, 34*a*, the control module 30 interprets the speed and direction commands from the user input device 28 and translates the speed and direction commands into control signals for controlling a speed and a rotational direction of each electric motor 32*a*, 34*a* and thus each propeller 46, 48. In other examples, small engines can be provided for each propulsion device 32, 34, instead of the electric motors 32*a*, 34*a* shown herein.

Figure 3:
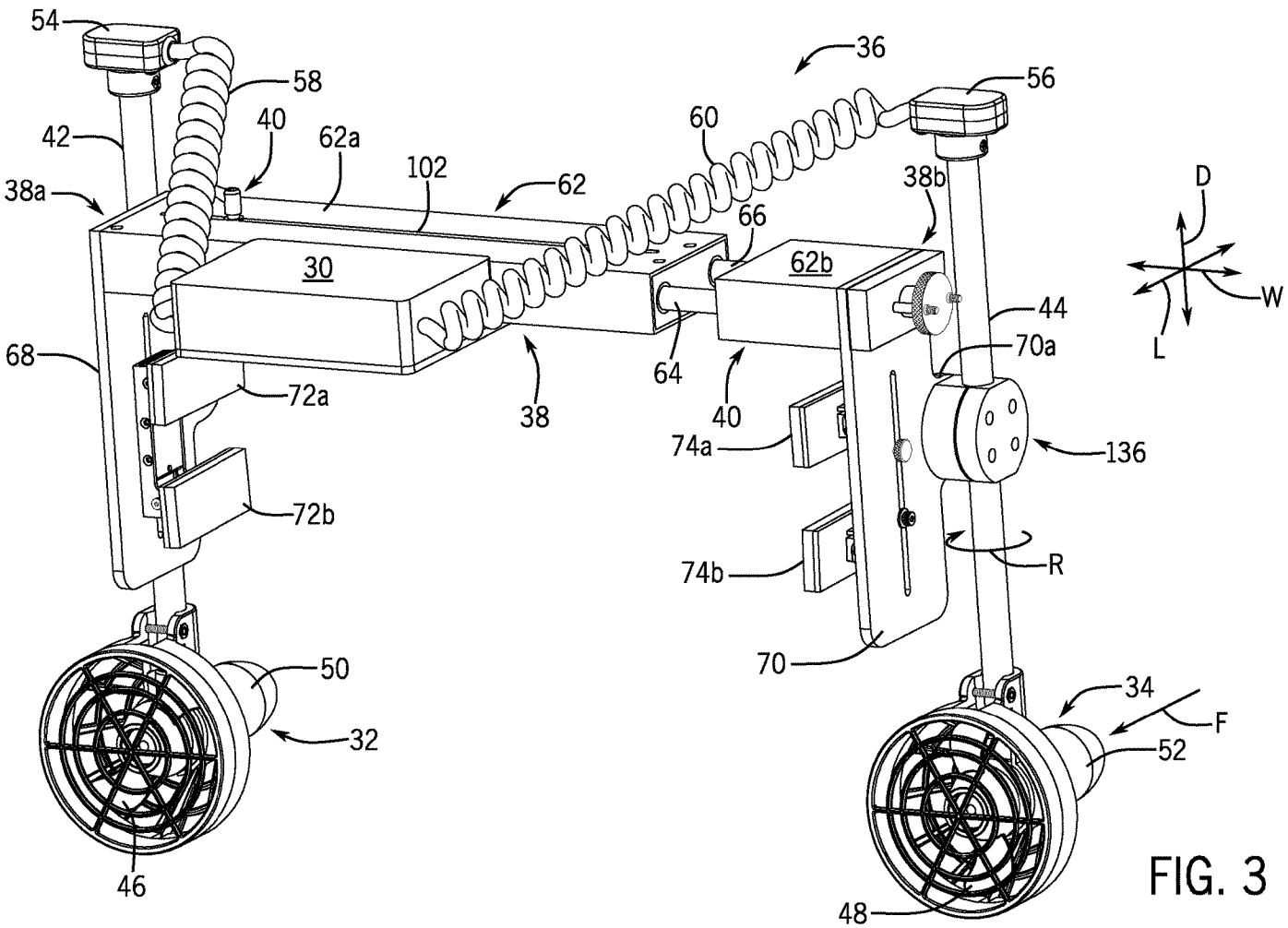
FIG. 3 illustrates a rear perspective view of the universal boat propulsion system.
Figure 4:
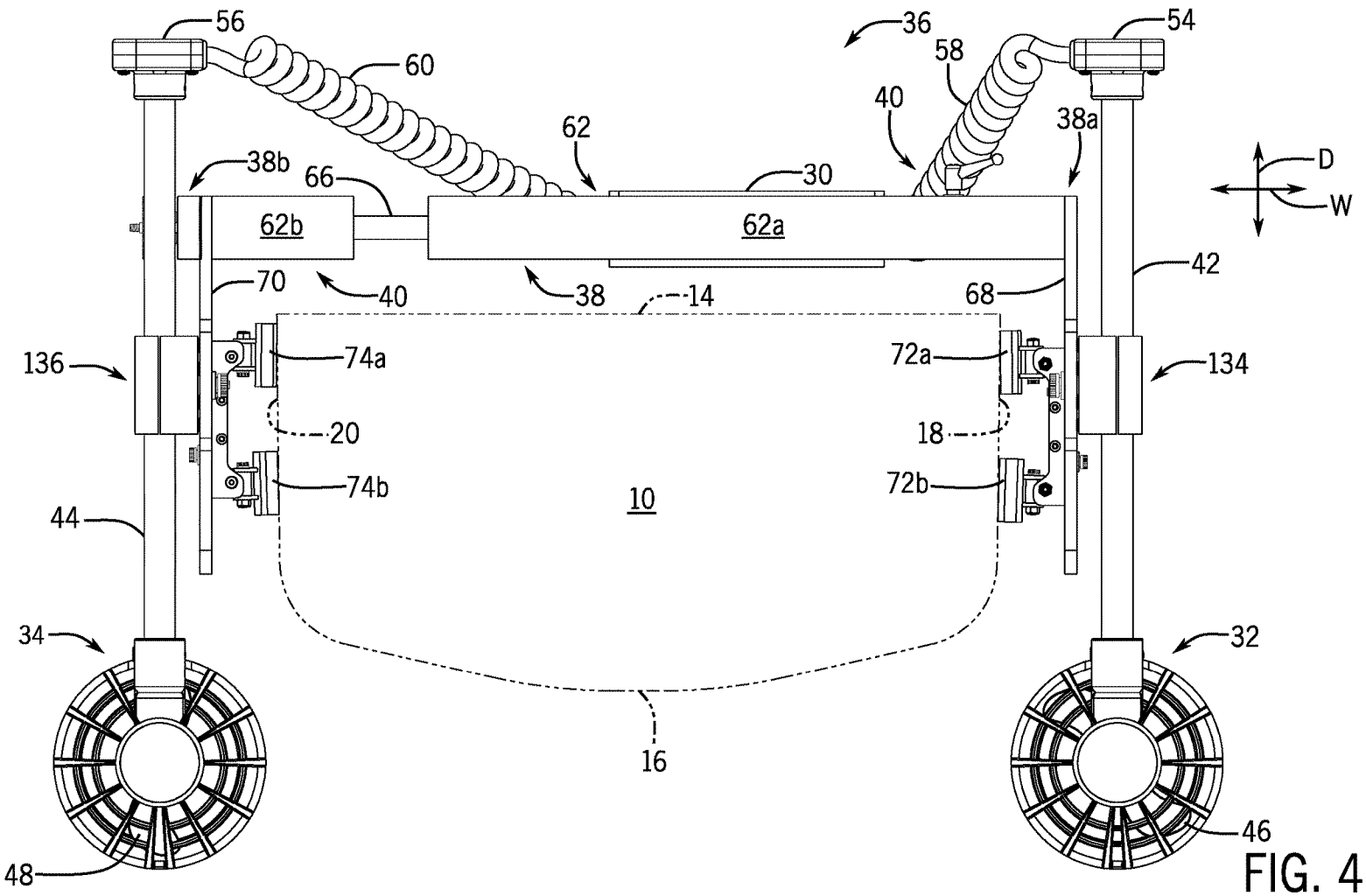
FIG. 4 illustrates a front view of the universal boat propulsion system.

Turning to FIGS. 3 and 4, the universal boat propulsion system (UBPS) 36 is shown therein. The UBPS 36 includes a support assembly 38 configured to span the boat 10 in the width direction W. This is shown in FIG. 4, where the boat 10 is shown in phantom, and the UBPS 36 is situated such that the support assembly 38 spans from one lateral side 18 to the other lateral side 20 of the boat 10. A dual-action clamping assembly 40 is configured to secure the support assembly 38 on the boat 10. A pair of shafts 42, 44 is coupled to respective opposite ends 38*a*, 38*b* of the support assembly 38. Each shaft 42, 44 in the pair of shafts extends in the depth direction D. The pair of propulsion devices 32, 34, which, as mentioned above, are configured to produce thrust to propel the boat 10, are each supported by a respective one of the shafts 42, 44. Here, the propulsion devices 32, 34 are supported at the bottom ends of the shafts 42, 44, respectively, and are therefore configured to be located below a surface of the water when the UBPS 36 is in use on the boat 10. In another example, the propulsion devices 32, 34 could be provided such that they extend somewhat above the surface of the water. In another example, the propulsion devices could be provided at the upper ends of the shafts 42, 44 and could propel the boat 10 by way of air propulsion.

Here, however, the propulsion devices 32, 34 shown are each marine propulsion devices, and include propellers 46, 48, which rotate due to connection with the respective electric motors 32*a*, 34*a*. The electric motors 32*a*, 34*a* could be provided in the hub 50, 52 of each propulsion device 32, 34 and directly connected to the propellers 46, 48 or connected to the propellers 46, 48 by way of transmission assemblies. Alternatively, the electric motors 32*a*, 34*a* could be provided in the heads 54, 56 of each propulsion device 32, 34 and connected to the propellers 46, 48 by way of rotating shafts provided within shafts 42, 44 and transmission assemblies. In any case, the electric motors 32*a*, 34*a* are provided in signal and power communication with the control module 30 by way of cables 58, 60. Note that the control module 30 could be of a different size or located elsewhere than how it is shown herein. Additionally, signal communication between the control module 30 and the electric motors 32*a*, 34*a* could be wireless, and if the battery 30*c* is provided somewhere other than within the control module 30, the control module 30 need not be connected to the remainder of the UBPS 36 by way of the cables 58, 60, and could therefore be provided elsewhere on the boat 10, remote from the support assembly 38.

The support assembly 38 is comprised of a number of parts, including a spanning portion 62 configured to traverse the boat 10 in the width direction W. As shown here, the spanning portion 62 is partially enclosed within two separate housings 62*a*, 62*b*. The spanning portion 62 includes a first member (here, the housing 62*a*) and at least a second member (here, parallel rods 64 and 66). In other examples, only one second member (rod 64 or rod 66) is provided. The first member 62*a* extends in the width direction W and the second member(s) 64 and/or 66 is/are parallel to the first member 62*a* and also extend(s) in the width direction W. The first and second members 62*a*, 64 and/or 66 are movable with respect to one another in the width direction W so as to adjust a width of the spanning portion 62 in order to fit the UBPS 36 on the boat 10, in a manner to be described herein below.

The support assembly 38 also includes a pair of brackets 68, 70 coupled to respective opposite ends of the spanning portion 62, which here coincide with opposite ends 38*a*, 38*b* of the support assembly 38. Each bracket 68, 70 in the pair of brackets extends in the depth direction D and is configured to be positioned on a respective side of the boat 10. In the example shown in FIG. 4, the brackets 68, 70 are positioned on respective outwardly facing surfaces of lateral sides 18, 20 of the boat 10. However, as mentioned herein above, these brackets 68, 70 could instead be positioned on the inwardly facing surfaces of lateral sides 18, 20 of the boat 10, such as if the boat 10 is a sit-on-top kayak, canoe, or rowboat and has lips formed around a recessed area.

Figure 5:
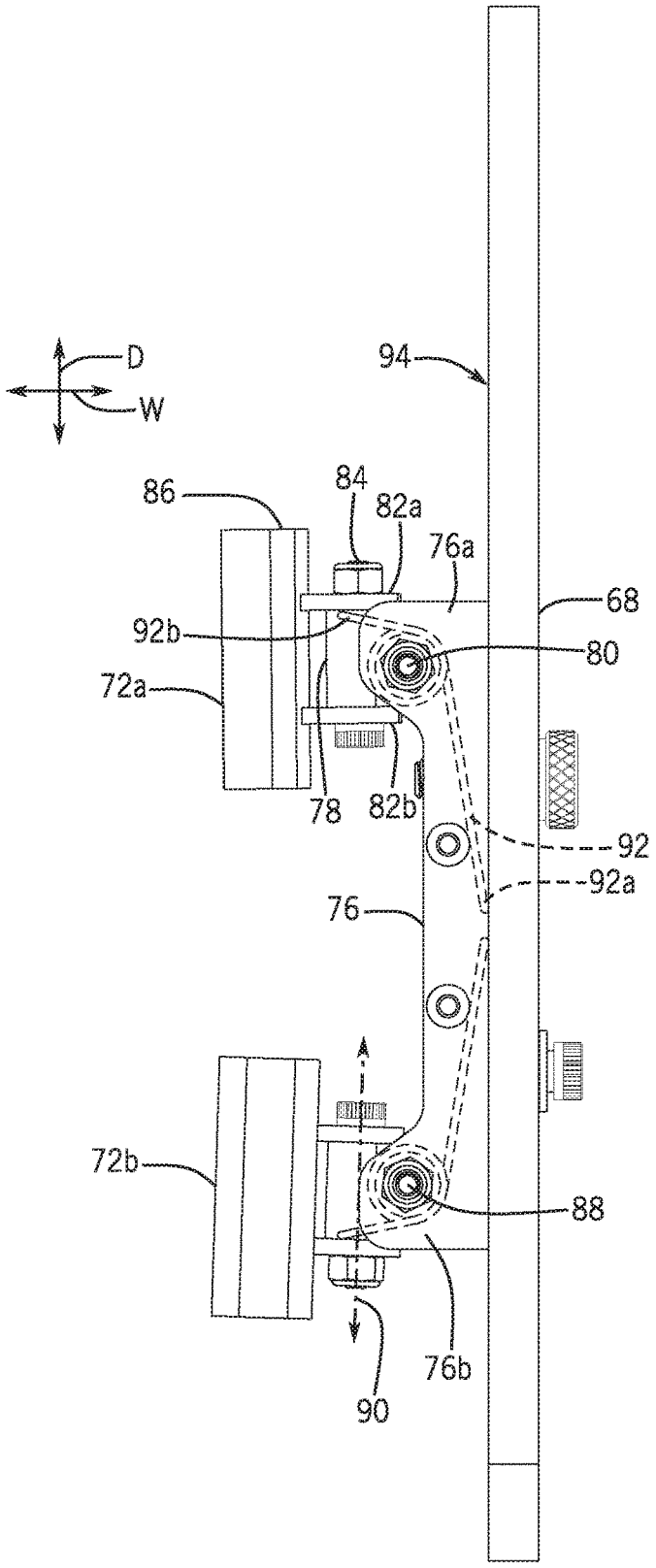
FIG. 5 provides a detailed view of a bracket and pad, which are part of a support assembly for the universal boat propulsion system.

Still referring to FIGS. 3 and 4, and now referring also to FIG. 5, pads 72*a*, 72*b*, 74*a*, 74*b* are coupled to each respective bracket 68, 70. The pads 72*a*, 72*b*, 74*a*, 74*b* are configured to be sandwiched between the respective bracket 68, 70 and the respective outer lateral side 18, 20 of the boat 10. For example, pads 72*a* and 72*b* are sandwiched between outer lateral side 18 and bracket 68, while pads 74*a* and 74*b* are sandwiched between outer lateral side 20 and bracket 70. FIG. 5 shows a detailed view of the pads 72*a*, 72*b* connected to bracket 68. It should be understood that the same description applies with respect to the pads 74*a*, 74*b* provided on bracket 70. A support bracket 76 is attached to bracket 68, for example by way of fasteners such as bolts or screws, by way of welding, or by any other known attachment mechanism. Support bracket 76 includes a lobed area 76*a* near its upper end, which is configured to hold the pad 72*a*, and a lobed area 76*b* near its lower end, which is configured to hold the pad 72*b*. The lobed area 76*a* is connected to a block 78 by way of a joint formed by a pin 80 and having a pivot axis in the length direction L. The block 78 is connected to a pair of brackets 82*a*, 82*b* extending in the width direction W by way of a joint formed by a pin 84 and having a pivot axis in the depth direction D. The pins 80, 84 may be partially threaded and may be held to the block 78 and to the respective brackets 76, 82*a*, 82*b* by way of nuts. Cotter pin connections could alternatively be used. Brackets 82*a*, 82*b* are in turn connected to a plate 86, which is in turn connected to pad 72*a*. The connection between brackets 82*a*, 82*b* and plate 86 may be welded, bolted, or integral, while the connection between the pad 72*a* and the plate 86 may be made by way of adhesive or by bolting. Together, the pins 80, 84 and block 78 make up a universal joint, which allows the plate 86 and pad 72*a* connected thereto to rotate about axes in both the length direction L and the depth direction D. It should be noted that the lower pad 72*b* is connected to the support bracket 76 at lobed area 76*b* in the same way as is the upper pad 72*a*, and thus, these pivot axes, corresponding to pin 80 and pin 84, are shown at 88 and 90, respectively.

A spring 92 is wound around the pin 80 at the upper lobed area 76*a* of the support bracket 76. The spring 92 is a torsion spring having a first end 92*a* that presses against an inner surface 94 of the support bracket 76, and second end 92*b* that is situated inside the block 78. The spring 92 acts to maintain the pad 72*a* parallel to the depth direction D when the pad 72*a* is not in contact with the respective outer lateral side 18 of the boat 10. In this way, the boater can place the UBPS 36 over boats having sides with different shapes and sizes. Because the spring 92 prevents the pad 72*a* from rotating away from being parallel to the depth direction D, the boater does not need to worry about orienting the pad 72*a* correctly when first placing the UBPS 36 over the boat 10. After the boater has placed the UBPS 36 over the boat, however, the boater can then adjust the pad 72*a* to fit the outer lateral side 18 or top surface 14 of the boat 10, depending on the boat's type, shape, and size. The universal joint (made up of pin 80, pin 84, and block 78) allows the pad 72*a* to rotate to lie flat or approximately flat against the outer lateral side 18 or top surface 14 of the boat 10 upon such manipulation by the boater. Note that a similar spring is provided for the lower pad 72*b*, which provides the same function as the spring 92 described with respect to the upper pad 72*a*. Universal joints and springs are provided on pads 74*a*, 74*b* as well.

Figure 6:
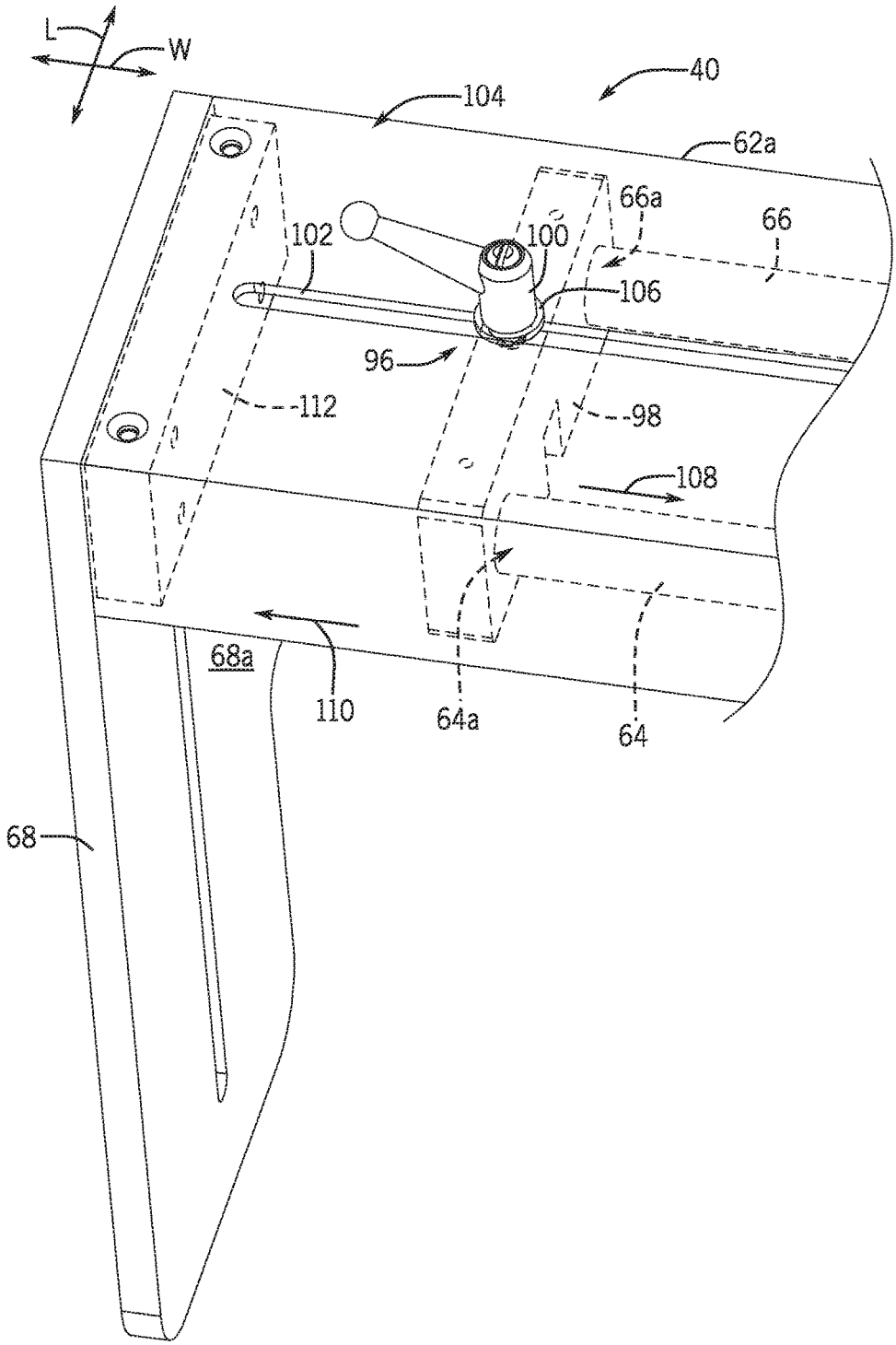
FIG. 6 illustrates a gross-adjustment mechanism that is user-actuated, which is part of a clamping assembly for the universal boat propulsion system.

Now referring to FIGS. 3, 4, and 6, further details of the support assembly 38 and the clamping assembly 40 will be described. The clamping assembly 40 includes a gross-adjustment mechanism 96, which is located partially within housing 62*a* of the spanning portion 62. One end of housing 62*a* is coupled to bracket 68 by way of block 112. It can be seen that rods 64 and 66 extend through the housing 62*a* from its opposite end and connect at their ends 64*a*, 66*a* to a block 98 located within the housing 62*a*. The opposite ends 64*b*, 66*b* of rods 64 and 66 are coupled to bracket 70 by way of housing 62*b*, as will be described further herein below with respect to FIG. 7. The block 98 has a screw or other type of fastener threaded therein, which here is a thumb screw 100. The thumb screw 100 extends through a slot 102 formed in the top surface 104 of the housing 62*a*. A washer 106 provides a snug fit between the tightened thumb screw 100 and the top surface 104 of the housing 62*a*. The block 98 fits snugly enough within the housing 62*a* that the rods 64 and 66 do not tilt with respect to the longitudinal axis of the housing 62*a*, but loosely enough therein that the block 98 can slide back and forth within the housing 62*a* in the width direction W. Such movement of the block 98 allows the boater to pull the brackets 68, 70 apart from one another or to push the brackets 68, 70 closer to one another, in order to position the brackets 68, 70 and pads 72*a*, 72*b*, 74*a*, 74*b* proximate the lateral sides of boats of various widths.

When the boater moves brackets 68 and 70 away from one another in the width direction W, this moves rods 64, 66 and block 98 connected thereto in the direction of arrow 108 with respect to the housing 62*a*. Assuming the thumb screw 100 is not tightened enough to place pressure on the washer 106 against the top surface 104 of the housing 62*a*, the thumb screw 100 slides within the slot 102 along with the block 98. When the boater moves brackets 68 and 70 toward one another in the width direction W, this moves rods 64, 66 and block 98 in the direction of arrow 110 with respect to the housing 62*a*. Again, assuming the thumb screw 100 is not tightened enough to place pressure on the washer 106 against the top surface 104 of the housing 62*a*, the thumb screw 100 slides within the slot 102 along with the block 98. However, if the thumb screw 100 is sufficiently tightened, the block 98 is not easily moved because it is held against the upper inside wall of the housing 62*a* by the force of the thumb screw 100, and the washer 106 is held tightly against the top surface 104 of the housing 62*a*. Thus, the gross-adjustment mechanism 96 is a user-actuated adjustment mechanism that couples the first member (housing 62*a*) and the second member(s) (rods 64, 66) of the spanning portion 62 together (e.g., by way of block 98 and thumb screw 100), and is configured to hold the first and second members 62*a*, 64, 66 stationary with respect to each other (e.g., upon tightening of the thumb screw 100).

Note that the slot 102 could instead be provided on one of the side surfaces or the bottom surface of the housing 62*a*. Note too that a screw with a handle on its top or preset holes in the top surface 104 of the housing 62*a* and a pin could be used instead of the thumb screw 100 to maintain the position of the rods 64, 66 with respect to the housing 62*a* after the boater has adjusted the opposite sides of the spanning portion 62 with respect to one another. Additionally or alternatively, the housing 62*a* could be an open structure such as a frame or cage, and need not be the enclosed structure shown here. The housing 62*a* and block 98 could have shapes other than those shown herein as well.

With the thumb screw 100 loosened, the boater can pull the brackets 68 and 70 apart from one another enough that the UBPS 36 spans over the boat 10 and can place the UBPS 36 at a desired location along the length of the boat 10. Note that the UBPS 36 could be provided anywhere along the boat 10 in the length direction L. For example, the UBPS 36 could be placed directly in front of the opening 12 where the boater sits, or directly behind the opening 12 in the boat 10. Different placements for the UBPS 36 may be more desirable than others depending on the shape and size of the boat 10 and the number and positioning of boaters. Once the UBPS 36 is positioned as desired, the boater can move the brackets 68 and 70 toward one another by pushing on the outer side of either bracket 68 and/or 70 and/or by moving thumb screw 100 along slot 102. Prior to tightening of thumb screw 100 and fixing of rods 64 and 66 with respect to housing 62*a*, the boater can adjust the pads 72*a*, 72*b*, 74*a*, 74*b* against the outer lateral sides 18, 20 of the boat 10 such that the pads 72*a*, 72*b*, 74*a*, 74*b* contact the outer lateral sides 18, 20 and/or top surface 14 of the boat 10 in a flush or nearly flush manner, due to the provision of the universal joints associated therewith. The boater can then tighten the thumb screw 100, thereby prohibiting further movement of the rods 64, 66 with respect to the housing 62*a*, and clamping the UBPS 36 in place at the selected location.

Figure 7:
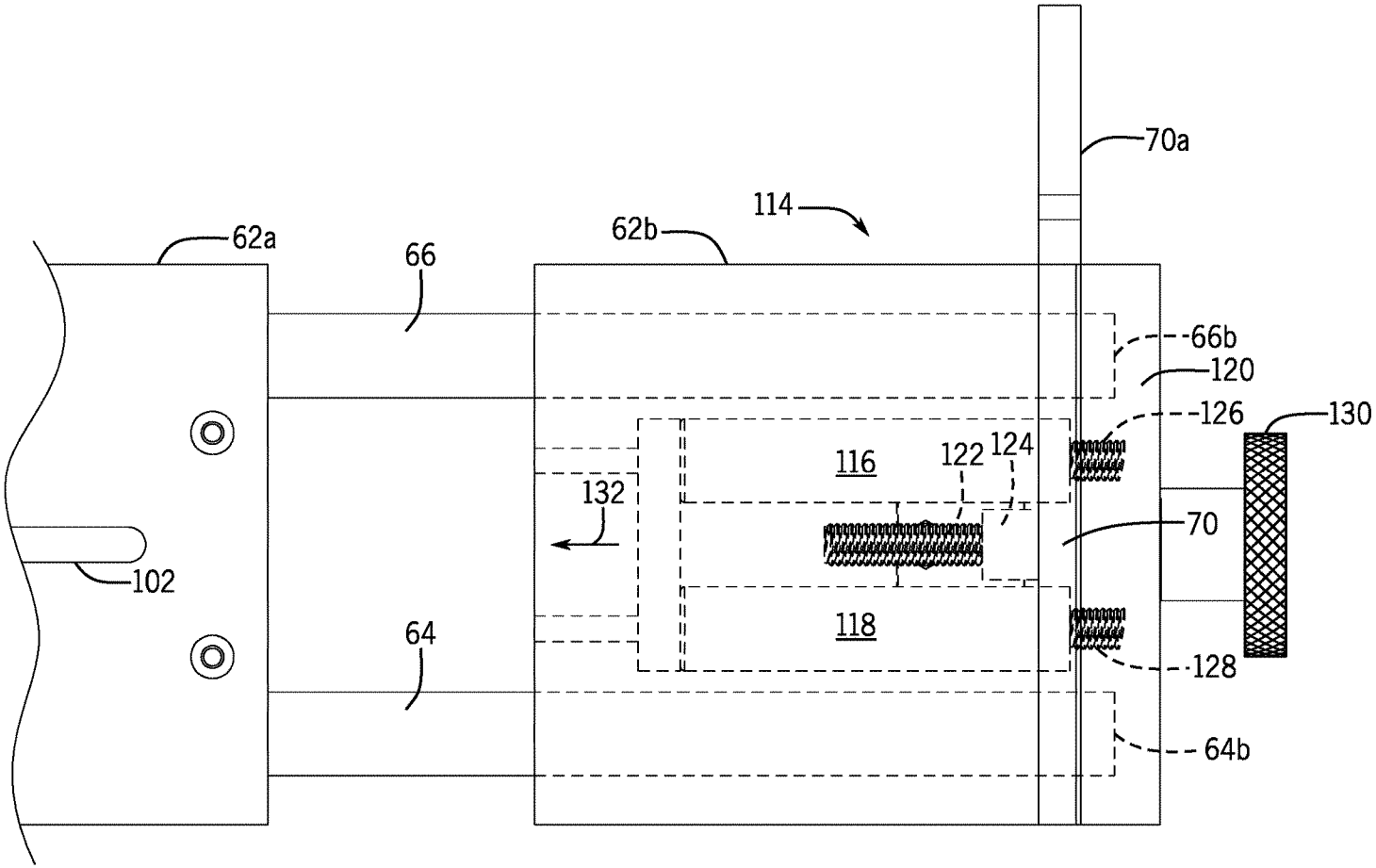
FIG. 7 illustrates a fine-adjustment mechanism that is mechanically-actuated, which is also part of the clamping assembly for the universal boat propulsion system.

Next, referring to FIGS. 3, 4, and 7, a fine-adjustment mechanism 114, which is also part of the clamping assembly 40, can be used to provide a desired final clamping force of the pads 72*a*, 72*b*, 74*a*, 74*b* against the outer lateral sides 18, 20 of the boat 10. The fine-adjustment mechanism 114 couples one of the brackets (here, bracket 70) to one of the first and second members of the spanning portion 62 (here, rods 64 and 66). Note that rods 64 and 66 extend through the open interior of housing 62*b* of the spanning portion 62 and are coupled to bracket 70 near ends 64*b*, 66*b* opposite those that are connected to block 98 (see FIG. 6). The fine-adjustment mechanism 114 is configured to load one of the brackets (here, bracket 70), and the respective pads 74*a*, 74*b* coupled thereto, against the respective outer lateral side (here, side 20) of the boat 10. In the present example, such loading is provided by way of a pair of gas shocks 116, 118, which are preloaded to apply the correct amount of force to the bracket 70 to bring the pads 74*a*, 74*b* into contact with the outer lateral side 20 of the boat 10. Thus, the fine-adjustment mechanism 114 is a mechanically-actuated adjustment mechanism.

A block 120 is provided on an outer lateral side of the bracket 70, which block 120 remains stationary upon actuation of the gas shocks 116, 118. The rods 64 and 66 are non-movably connected to the block 120, such as by way of pins extending through the block 120 and rods 64, 66 at ends 64*b*, 66*b*, although such pinned connections are not shown herein. Because the rods 64, 66 are held in place with respect to the housing 62*a* and bracket 68 by way of the clamping force provided by gross-adjustment mechanism 96, the distance between the block 120 and the bracket 68 does not change when the fine-adjustment mechanism 114 is actuated. However, the rods 64, 66 extend through apertures in the bracket 70, and therefore the bracket 70 can slide along the rods 64, 66 under the force of the gas shocks 116, 118. The gas shocks 116, 118 are threadedly connected to the block 120 by way of the threaded connections shown in phantom at 126, 128. Thus, the rod ends of the gas shocks 116, 118 are also stationary, due to their connection with the block 120. A screw 122, which extends through the block 120 and the bracket 70 into the housing 62*b*, provides a preload on the gas shocks 116, 118 by way of being threaded into a preload block 124 situated on an opposite side of the bracket 70 than is the block 120. Upon loosening of a knob 130 connected to the screw 122, the preload is released and the gas shocks 116, 118 expand. Because the block 120 remains stationary, this force causes the bracket 70, cylinder ends of the gas shocks 116, 118, and the housing 62*b* to move away from the block 120, in the direction of the arrow 132. This way, the initial placement of the rods 64, 66 with respect to the housing 62*a* is not changed; rather, the bracket 70 is forced away from the block 120 and toward the outer lateral side 20 of the boat 10. The block 98 therefore does not move during this fine adjustment procedure. The fine-adjustment mechanism 114, because it is mechanically-actuated and designed to impart the correct amount of compressive force to the pads 74*a*, 74*b* and against the side of the boat 10, prevents damage to the boat 10 due to overtightening that might otherwise result from user-actuation only of the clamping assembly 40.

Note that both of the adjustment mechanisms 96, 114 are not required on the UBPS 36. For instance, if the UBPS 36 is intended always to be used on the same size boat, the gross-adjustment mechanism 96 need not be provided. Alternatively, if the UBPS 36 is desired to have fewer components and less expense, the fine-adjustment mechanism 114 need not need be provided. Alternatively, a different type of fine-adjustment mechanism could be provided, such as a spring, a set of screws, a screw with a ball detent that skips once a certain pressure has been applied to the pads 74*a*, 74*b*, or another similar device could be used to exert the correct amount of clamping pressure on the boat 10 by the pads 74*a*, 74*b*.

Thus, to install the UBPS 36, the boater loosens the thumb screw 100 of the gross-adjustment mechanism 96, widens the space between the brackets 68, 70 until they are positioned on the outer lateral sides 18, 20 of the boat 10, and then closes the space between the brackets 68, 70 until the pads 72*a*, 72*b*, 74*a*, 74*b* are close to the outer lateral sides 18, 20. The boater then tightens the thumb screw 100 to fix the parts 62*a*, 64, 66 of the spanning portion 62 with respect to one another. After ensuring correct positioning of the pads 72*a*, 72*b*, 74*a*, 74*b* via the universal joints, the boater loosens the screw 122 of the fine-adjustment mechanism 114 by way of the knob 130, after which the gas shocks 116, 118 provide further clamping of the pads 74*a*, 74*b* against the outer lateral side 20 of the boat 10. The UBPS 36 is now fully installed and ready to be used.

Figure 8:
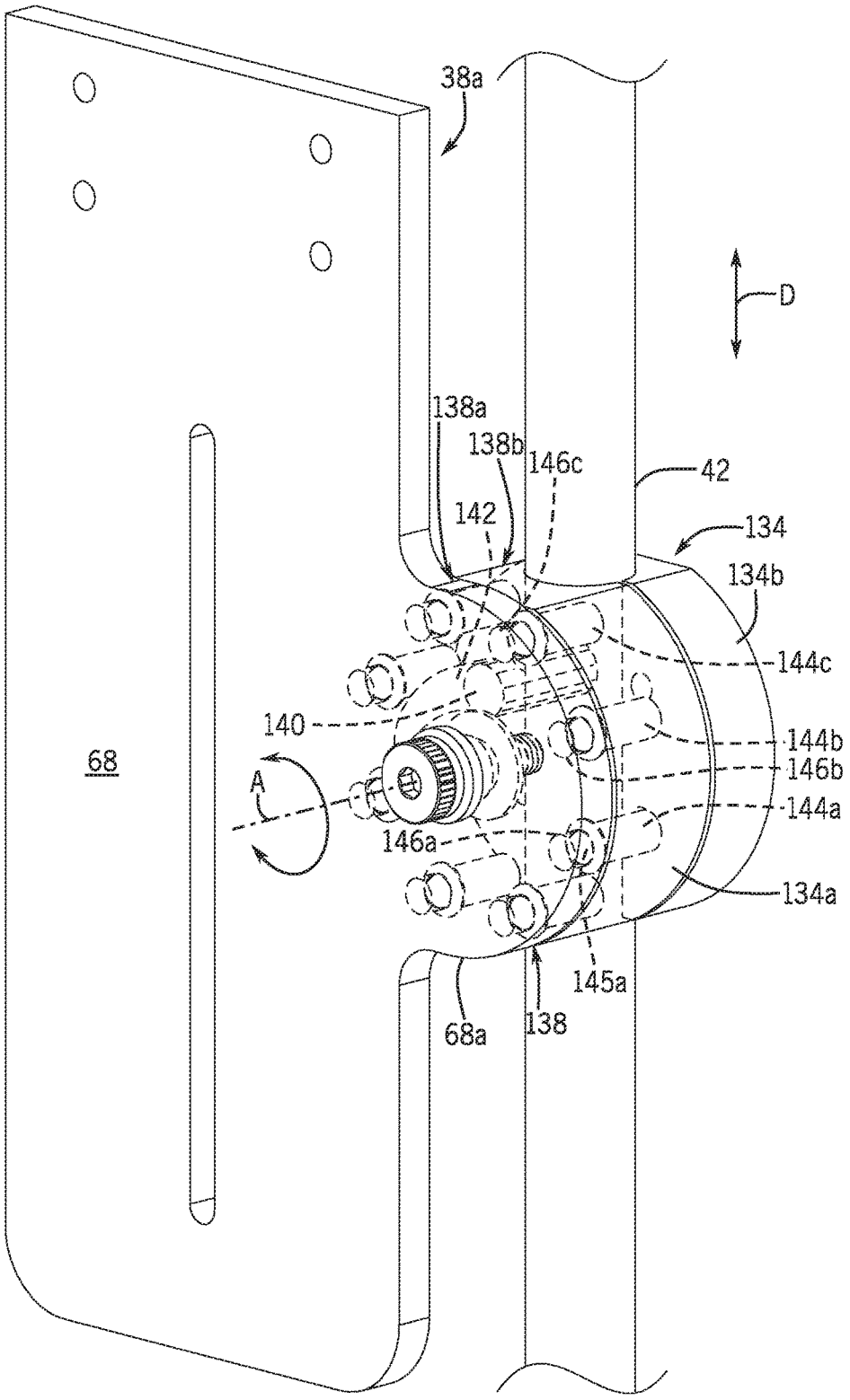
FIG. 8 illustrates a breakaway mechanism that is part of the universal boat propulsion system.

Turning now to FIGS. 3, 4, and 8, a breakaway mechanism 134 for the UBPS 36 will be described. Although the breakaway mechanism 134 will be shown with respect to the shaft 42 associated with bracket 68, it should be understood that a mirror image of such a breakaway mechanism 134 is provided for the shaft 44 on bracket 70. Each of the brackets 68, 70 includes an extended portion 68*a*, 70*a* (see FIGS. 3 and 7) to which a respective breakaway mechanism 134, 136 is attached. For example, breakaway mechanism 134 is attached to the extended portion 68*a* of bracket 68, while breakaway mechanism 136 is attached to the extended portion 70*a* of bracket 70. Each breakaway mechanism 134, 136 in the pair of breakaway mechanisms couples a respective shaft in the pair of shafts 42, 44 to a respective one of the ends 38*a*, 38*b* of the support assembly 38 and allows the respective shaft 42, 44 to rotate away from extending in the depth direction D toward extending in the length direction L in response to application of at least a threshold force to the respective shaft 42, 44 in the length direction L. For example, referring to FIG. 3, if a force F of greater than a threshold was applied to the propulsion device 34, the breakaway mechanism 136 would allow the shaft 44 to rotate in the direction of arrow R in order that the propulsion device 34 would not be damaged by whatever the propulsion device 34 struck that applied the force F. Alternatively, the boater could choose to rotate the shaft 44 by applying force in the length direction L and greater than the threshold to the top end of the shaft 44, near the head 56, in order to raise the propulsion device 34 out of the water and clean seaweed or other obstructions from the propeller 48. Note that in either instance, the force that is applied needs to be greater if the application is closer to the breakaway mechanism 136, due to the shorter moment arm, or less if the application is further from the breakaway mechanism 136, due to longer moment arm.

Returning to FIG. 8, the axis of rotation A for the breakaway mechanism 134 is shown therein in dashed lines. The breakaway mechanism 134 is capable of rotating because the breakaway mechanism 134 is coupled to a respective one of the ends of the support assembly 38 (here to end 38*a* by way of bracket 68) by way of a planar joint 138. The planar joint 138 is provided between an outwardly facing surface of the extended portion 68*a* of the bracket 68 and an inwardly facing surface of a first half 134*a* of the breakaway mechanism 134. The first half 134*a* of the breakaway mechanism 134 is coupled to the shaft 42 by way of sandwiching thereabout with a second half 134*b* of the breakaway mechanism 134, which halves 134*a*, 134*b* can be connected by fasteners. In this way, a support half 138*a* of the planar joint 138 (here, extended portion 68*a* of bracket 68) is fixed with respect to the support assembly 38, and a breakaway half 138*b* of the planar joint 138 (here, first half 134*a* of breakaway mechanism 134) is fixed with respect to the shaft 42. A pin 140 extends from the inwardly facing surface of the first half 134*a* of the breakaway mechanism 134 and rides within a curved slot 142 formed in the extended portion 68*a* of the bracket 68. Although provision of this pin 140 and slot 142 will prevent the shaft 42 from rotating more than a predetermined amount away from the depth direction D, a detent mechanism nonetheless may be provided in order to hold the shaft 42 at given angular displacements away from the depth direction D. For example, as shown herein, at least one ball detent 144*a*, 144*b*, 144*c*, etc. is provided that extends between the support and breakaway halves 138*a*, 138*b* of the planar joint 138. Each ball (for example, ball 145*a*) of the ball detents 144*a*, 144*b*, 144*c*, etc. is held by a spring or other biasing mechanism in a corresponding receiving hole 146*a*, 146*b*, 146*c*, etc. formed in the extended portion 68*a* of the bracket 68. These balls hold the breakaway half 138*b* stationary with respect to the support half 138*a* of the planar joint 138.

However, upon application of force greater than the predetermined threshold to the shaft 42 or the propulsion device 32 associated therewith, force on the balls will press the associated biasing mechanisms into the breakaway half 138*b* of the planar joint 138, i.e. into the first half 134*a* of the breakaway mechanism 134. The spring constant of the biasing mechanisms and the number of ball detents provided will dictate the threshold force required to cause the balls to move in this manner. With the balls no longer holding the first half 134*a* of the breakaway mechanism 134 stationary with respect to the extended portion 68*a* of bracket 68, the entire breakaway mechanism 134 and shaft 42 connected thereto are free to rotate with respect to the extended portion 68*a*. Thus, the ball detents 144*a*, 144*b*, 144*c*, etc. extending between the support and breakaway halves 138*a*, 138*b* of the planar joint 138 hold the breakaway half 138*b* of the planar joint 138 stationary with respect to the support half 138*a* of the planar joint 138 when at least the threshold force F is not applied to the shaft 42 in the length direction L.

This arrangement for the breakaway mechanisms 134, 136 on the brackets 68, 70 works well when the brackets 68, 70 are configured to be positioned on outwardly facing surfaces (e.g. outer lateral sides 18, 20) of the boat 10. In the event that the brackets 68, 70 are configured to be positioned on inside surfaces of sides/lips of the boat, the breakaway mechanisms and associated shafts may need to be provided further laterally outward from the brackets 68, 70 in order that the propulsion devices 32, 34 clear the sides of the boat 10 and can be located in the water. As an alternative to the ball detent breakaway system described herein, a torsion spring, linear spring, gas shock, or magnetic breakaway system could be used.

Referring back to FIGS. 3 and 4, note that while the propulsion devices 32, 34 could be rotatable about an axis extending in the longitudinal direction of the shafts 42, 44, in the present example, the propulsion devices 32, 34 are not rotatable with respect to the shafts 42, 44 and produce thrust in the length direction L only. This allows the propulsion devices 32, 34 to be much simpler and therefore less expensive then rotatable propulsion devices, as well as less susceptible to mechanical breakdowns. By altering the thrusts produced by each of the propulsion devices 32, 34, both in terms of propeller direction as being in forward or reverse and in terms of propeller speed, different maneuvers of the boat 10 can be accomplished.

Figure 9A:
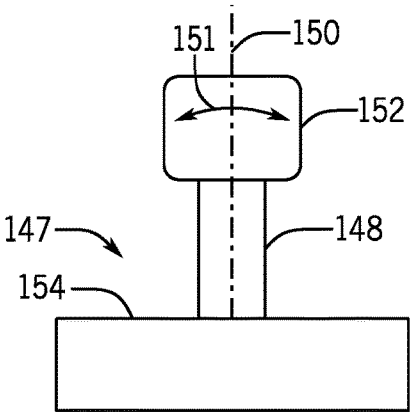
FIG. 9A illustrates a side view of a first example of a user input device for use with the universal boat propulsion system.
Figure 9B:
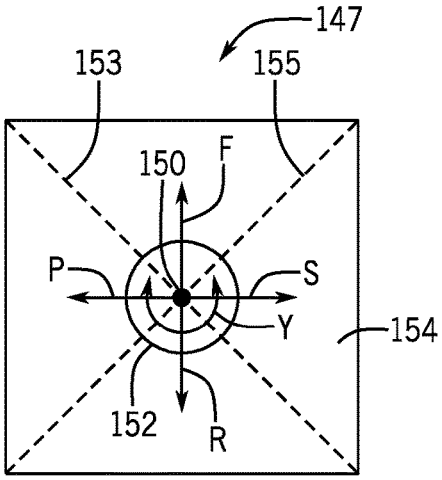
FIG. 9B illustrates a top view of the first example of the user input device.

FIGS. 9A and 9B show one example of the user input device 28, in which the user input device is a joystick 147. FIG. 9A is a simplified schematic representation of the joystick 147, which can be used to provide a signal that is representative of a desired movement, selected by the boater, relating to the boat 10. The example in FIG. 9A shows a base 154 and a handle 148, which can be manipulated by hand by way of grasping a knob 152. In a typical application, the handle 148 is movable in the direction generally represented by arrow 151. It should be understood that the joystick handle 148 is movable by tilting it about its connection point in the base 154 in virtually any direction. Although arrow 151 is illustrated in the plane of the drawing in FIG. 9A, a similar type of movement is possible in other directions that are not parallel to the plane of the drawing. Additionally, the knob 152 at the upper end of the handle 148 is rotatable with respect to the handle 148 about a longitudinal handle axis 150.

FIG. 9B is a top view of the joystick 147. The handle 148 can move, as indicated by arrow 151 in FIG. 9A, in various directions, including those represented by arrows F (forward), R (reverse), S (starboard), and P (port). However, it should be understood that the handle 148 can move in any direction relative to the base 154 and is not limited to the lines of movement represented by arrows F, R, S, and P. In fact, the handle 148 has a virtually infinite number of possible paths as it is tilted about its connection point within the base 154. It can be seen that the boater can demand a purely linear movement either toward port, as represented by arrow P, or starboard, as represented by arrow S, a purely linear movement in a forward direction, as represented by arrow F, or reverse direction as represented by arrow R, or any combination of two of these directions. By way of example, by moving the handle 148 along dashed line 155, a linear movement toward the right side and forward can be commanded. Similarly, by moving the handle 148 along dashed line 153, a linear movement toward the left side and forward can be commanded. As noted, the knob 152 can also be rotated with respect to the axis 150 as shown by the arrow Y. The boater can do this while the handle 148 is positioned vertically upright with respect to the base 154 or at the same time as he or she tilts the handle 148 with respect to the base 154. It should be understood that the boater can in this way request a combination of sideways or forward/reverse linear movement in combination with yawing rotation of the boat 10, such as by tilting the handle 148 with respect to the base 154 and rotating the knob 152 about the axis 150 at the same time.

The magnitude, or intensity, of movement represented by the position of the handle 148 and/or knob 152 is also provided as an output from the joystick 147, which represents the boater's desired speed. In other words, if the handle 148 is tilted slightly toward one side or the other as shown by arrow 151, the commanded thrust in that direction is less than if, alternatively, the handle 148 was tilted by a greater magnitude away from its vertically upright position with respect to the base 154. Furthermore, rotation of the knob 152 about axis 150, as represented by arrow Y, provides a signal representing the intensity of desired rotation of the boat 10. A slight rotation of the knob 152 about axis 150 would represent a command for a slight rotational thrust. On the other hand, a more intense rotation of the knob 152 about axis 150 would represent a command for a higher magnitude of rotational thrust.

Upon receiving the speed and direction commands from the joystick 147, the control module 30 translates the speed and directions commands into control signals to control speed and rotational direction of the electric motors 32*a*, 34*a*. For example, the control module 30 uses vector math to compute the speed of each electric motor 32*a*, 34*a* and the direction of thrust (forward or reverse) of each electric motor 32*a*, 34*a* that is required in order to achieve the speed and direction request that was input by the boater via the joystick 147. According to such an algorithm, the rotational speed of the propellers 46, 48 and the rotational direction of the propellers 46, 48 on each electric motor 32*a*, 34*a* need not be the same as one another, depending on the requested movement of the boat 10.

Figure 10A:
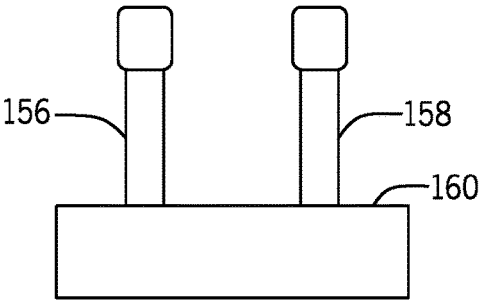
FIG. 10A illustrates a side view of a second example of a user input device for use with the universal boat propulsion system.
Figure 10B:
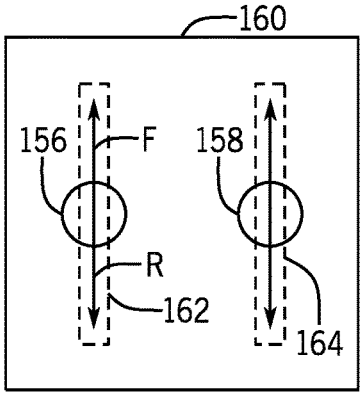
FIG. 10B illustrates a top view of the second example of the user input device.

Now turning to FIGS. 10A and 10B, an alternative user input device 28 is shown. Here, the user input device is a set of control levers 156, 158 connected to a base 160. The control lever 156 is movable in a forward and reverse direction within a slot 162 in the base 160, as shown in the top view of FIG. 10B, while the control lever 158 is movable within a slot 164. Each control lever 156, 158 is associated with a given propulsion device, 32, 34, respectively. That is, control lever 156 controls the speed and rotational direction of the propeller 46 of propulsion device 32, wherein a further motion of the control lever 156 in the forward direction F is a request for more speed in the forward direction, while a further motion of the control lever 156 in the reverse direction R is a request for more speed in the reverse direction. Similarly, control lever 158 controls speed and direction of the propeller 48 of propulsion device 34. In this example, the control module 30 does not need to perform vector math to interpret the speed and direction commands from the control levers 156, 158. Rather, the control module 30 can directly translate the speed and direction commands into the control signals for controlling the electric motors 32*a*, 34*a* of the individual propulsion devices 32, 34.

Using two fixed-heading propulsion devices 32, 34 rather than a single rotatable propulsion device or a non-rotatable propulsion device and a rudder provides the boater with more control over the propulsion of the boat 10. For instance, if one of the propulsion devices 32 is operated in forward while the other propulsion device 34 is operated in reverse, the boater is able to cause the boat 10 to yaw in place, a motion which was heretofore not available from small boat propulsion systems on the market. Additionally, the boater can have precise control over turns and is able to provide such control by way of an intuitive user input device. Note that many alternative user input devices are possible within the scope of the present disclosure. For example, a pair of foot peddles, similar to the pair of control levers 156, 158, may be provided for controlling each of the propulsion devices 32, 34. A steering wheel and a separate speed input device could instead be provided, the signals from which would be interpreted by the control module 30 in order to control the propulsion devices 32, 34.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A universal boat propulsion system for a boat defined in a length direction, a width direction, and a depth direction, the system comprising:

a support assembly configured to span the boat in the width direction, the support assembly comprising:

a spanning portion configured to traverse the boat in the width direction; and a pair of brackets coupled to respective opposite ends of the spanning portion;

wherein each bracket in the pair of brackets extends in the depth direction and is configured to be positioned only on an outwardly facing surface of a respective outer lateral side of the boat;

a clamping assembly configured to secure the support assembly on the boat;

a pair of shafts coupled to respective opposite ends of the support assembly, each shaft in the pair of shafts extending in the depth direction;

a pair of propulsion devices configured to produce thrust to propel the boat, each propulsion device in the pair of propulsion devices being supported by a respective one of the shafts; and a user input device configured to control operation of the pair of propulsion devices.

2. The system of claim 1, further comprising a pad coupled to each respective bracket, wherein the pad is configured to be sandwiched between the respective bracket and the respective outer lateral side of the boat.

3. The system of claim 2, further comprising a universal joint and a spring coupling the pad to the respective bracket, wherein the universal joint allows the pad to rotate to lie flat against the respective outer lateral side of the boat, and the spring maintains the pad parallel to the depth direction when the pad is not in contact with the respective outer lateral side of the boat.

4. The system of claim 1, further comprising a pair of breakaway mechanisms, each breakaway mechanism in the pair of breakaway mechanisms coupling a respective shaft in the pair of shafts to a respective one of the ends of the support assembly and allowing the respective shaft to rotate away from extending in the depth direction toward extending in the length direction in response to application of at least a threshold force to the respective shaft in the length direction.

5. The system of claim 4, wherein each breakaway mechanism is coupled to the respective one of the ends of the support assembly by way of a planar joint, a support half of the planar joint being fixed with respect to the support assembly and a breakaway half of the planar joint being fixed with respect to the respective shaft, and by way of at least one ball detent extending between the support and breakaway halves of the planar joint and holding the breakaway half of the planar joint stationary with respect to the support half of the planar joint when at least the threshold force is not applied to the respective shaft in the length direction.

6. The system of claim 5, wherein the support half of the planar joint is a respective one of the brackets in the pair of brackets.

7. The system of claim 2, wherein the spanning portion comprises a first member extending in the width direction and a second member that is parallel to the first member and also extends in the width direction, wherein the first and second members are movable with respect to one another in the width direction so as to position each pad in contact with the respective outer lateral side of the boat.

8. The system of claim 7, wherein the clamping assembly comprises:

a gross-adjustment mechanism coupling the first and second members of the spanning portion together and configured to hold the first and second members of the spanning portion stationary with respect to each other; and a fine-adjustment mechanism coupling one of the brackets in the pair of brackets to one of the first and second members of the spanning portion and configured to load the one of the brackets and the respective pad coupled thereto against the respective outer lateral side of the boat.

9. The system of claim 1, wherein each propulsion device comprises an electric motor turning a propeller, and further comprising a control module providing signal communication between the user input device and each electric motor.

10. The system of claim 9, wherein each propulsion device produces thrust in the length direction only, and wherein the control module interprets speed and direction commands from the user input device and translates the speed and direction commands into control signals for controlling a speed and a rotational direction of each electric motor.

11. A universal boat propulsion system for a boat defined in a length direction, a width direction, and a depth direction, the system comprising:

a support assembly configured to span the boat in the width direction, the support assembly comprising:

a spanning portion configured to traverse the boat in the width direction; and a pair of brackets coupled to respective opposite ends of the spanning portion;

wherein each bracket in the pair of brackets extends in the depth direction and is configured to be positioned proximate a respective lateral side of the boat;

a clamping assembly configured to secure the support assembly on the boat;

a pair of shafts coupled to respective opposite ends of the support assembly, each shaft in the pair of shafts extending in the depth direction;

a pair of breakaway mechanisms, each breakaway mechanism in the pair of breakaway mechanisms coupling a respective shaft in the pair of shafts to a respective one of the ends of the support assembly and allowing the respective shaft to rotate away from extending in the depth direction toward extending in the length direction in response to application of at least a threshold force to the respective shaft in the length direction;

a pair of propulsion devices powered by a pair of electric motors, respectively, and configured to produce thrust to propel the boat, each propulsion device in the pair of propulsion devices being supported by a respective one of the shafts;

a user input device for inputting speed and direction commands to control the thrust produced by the pair of propulsion devices; and a control module interpreting the speed and direction commands from the user input device and translating the speed and direction commands into control signals for controlling a speed and a rotational direction of each electric motor in the pair of electric motors.

12. The system of claim 11, further comprising a pad coupled to each respective bracket, wherein the pad is configured to be sandwiched between the respective bracket and the respective lateral side of the boat.

13. The system of claim 12, wherein the spanning portion comprises a first member extending in the width direction and a second member that is parallel to the first member and also extends in the width direction, wherein the first and second members of the spanning portion are movable with respect to one another in the width direction so as to position each pad in contact with the respective lateral side of the boat.

14. The system of claim 13, wherein the clamping assembly comprises:

a user-actuated adjustment mechanism coupling the first and second members of the spanning portion together and configured to hold the first and second members of the spanning portion stationary with respect to each other; and a mechanically-actuated adjustment mechanism coupling one of the brackets in the pair of brackets to one of the first and second members of the spanning portion and configured to load the one of the brackets and the respective pad coupled thereto against the respective lateral side of the boat.

15. The system of claim 11, wherein each breakaway mechanism is coupled to a respective one of the brackets in the pair of brackets.

16. The system of claim 11, wherein each bracket is configured to be positioned on an outwardly facing surface of the respective lateral side of the boat.

17. The system of claim 11, wherein the propulsion devices are not rotatable with respect to the respective shafts and produce the thrust in the length direction.

18. A universal boat propulsion system for a boat defined in a length direction, a width direction, and a depth direction, the system comprising:

a support assembly configured to span the boat in the width direction, the support assembly comprising:

a spanning portion configured to traverse the boat in the width direction; and a pair of brackets coupled to respective opposite ends of the spanning portion;

wherein each bracket in the pair of brackets extends in the depth direction and is configured to be positioned on a respective outer lateral side of the boat;

a pad coupled to each respective bracket, wherein the pad is configured to be sandwiched between the respective bracket and the respective outer lateral side of the boat;

a universal joint and a spring coupling the pad to the respective bracket, wherein the universal joint allows the pad to rotate to lie flat against the respective outer lateral side of the boat, and the spring maintains the pad parallel to the depth direction when the pad is not in contact with the respective outer lateral side of the boat;

a clamping assembly configured to secure the support assembly on the boat;

a pair of shafts coupled to respective opposite ends of the support assembly, each shaft in the pair of shafts extending in the depth direction;

a pair of propulsion devices configured to produce thrust to propel the boat, each propulsion device in the pair of propulsion devices being supported by a respective one of the shafts; and a user input device configured to control operation of the pair of propulsion devices.

* * * * *